US005833209A

United States Patent [19]

Steinrück

[11] Patent Number: 5,833,209

[45] Date of Patent: Nov. 10, 1998

[54] DEVICE AND METHOD FOR INFLUENCING THE PERIODIC STROKE MOVEMENT OF THE CLOSING ELEMENT OF A VALVE

[75] Inventor: Peter Steinrück, Vienna, Austria

[73] Assignee: Hoerbiger Ventilwerke Aktiengesellschaft, Vienna, Austria

[21] Appl. No.: 508,453

[22] Filed: Jul. 28, 1995

[30] Foreign Application Priority Data

Jul. 29, 1994 [AT] Austria ..... A 1498/94

[51] Int. Cl.[6] ..... F16K 31/12

[52] U.S. Cl. ..... 251/47; 417/446; 417/298; 91/35; 91/407; 91/450

[58] Field of Search ..... 417/298, 446, 417/375; 91/35, 407, 450; 251/47, 36

[56] References Cited

U.S. PATENT DOCUMENTS

| | | | |
|---|---|---|---|
| 1,798,435 | 3/1931 | Saharoff . | |
| 2,035,963 | 3/1936 | Hoerbiger et al. | 417/298 X |
| 2,296,304 | 9/1942 | Wolfert | 417/298 X |
| 2,620,776 | 12/1952 | Groves | 251/36 |
| 2,626,100 | 1/1953 | McIntyre | 417/298 X |
| 2,657,850 | 11/1953 | Borel . | |
| 3,104,801 | 9/1963 | Bancel . | |
| 3,149,536 | 9/1964 | Hewitt | 91/407 |
| 5,275,136 | 1/1994 | Schechter et al. | 251/47 |
| 5,378,117 | 1/1995 | Bennitt | 417/298 |
| 5,647,394 | 7/1997 | Valbjorn | 137/501 |

FOREIGN PATENT DOCUMENTS

| | | | |
|---|---|---|---|
| 1650330 | 7/1978 | Germany | 91/407 |
| 61-40469 | 2/1986 | Japan | 417/298 |

*Primary Examiner*—Timothy Thorpe
*Assistant Examiner*—Cheryl J. Tyler
*Attorney, Agent, or Firm*—Watson Cole Grindle Watson, P.L.L.C.

[57] ABSTRACT

To influence the periodic stroke movement of the closing element of a valve, a control cylinder working on the closing element in the stroke direction is provided, which can be acted upon or released by a control element periodically with pressure medium. The control element is connected in the supply or discharge conduit of the pressure medium and can variably accelerate or slow its pressure formation or release and with it also the stroke movement of the closing element, at last gradually. Thus a partially or completely automatic control of compressor valves, for example, can be made possible in a simple manner.

4 Claims, 5 Drawing Sheets

DEVICE AND METHOD FOR INFLUENCING THE PERIODIC STROKE MOVEMENT OF THE CLOSING ELEMENT OF A VALVE

BACKGROUND OF THE INVENTION

The invention relates to a device and a method for influencing the periodic stroke movement of the closing element of a valve, in particular the valve plate(s) of a valve of a reciprocating compressor, utilizing at least one control cylinder influencing the closing element in the stroke direction and which can be acted upon and released periodically with a pressure medium via a control element.

Different variations of activation are known for valves periodically opened or closed during the work cycle, primarily required for control of the course of the work in stroke piston machines such as combustion engines and similar machines, as well as pumps, compressors and the like. These extend in both stroke directions (i.e., positive valve control in combustion engines) from rigid, mechanical activation using spring loaded intermediate elements which are activated by cams or the like, to compressor valves spring loaded on only one side in the direction of closing, which are opened by the pressure of the gas flowing through. The latter type valve in particular, which is mostly self-activating for piston compressors, works with a free movement of the valve ring or valve plate which is caused only by the exchange of the engaging flow or pressure and spring force. The lay-out of a valve of this type thus causes compromises between the minimal flow loss and the maximum life expectancy and requires a great deal of experience or correspondingly developed calculation methods, since otherwise the danger exists of unforeseen operational disruptions or undesired operational behavior of the valve.

In the history of making piston compressors, repeated attempts have been made to use proven positively controlled valves in, for example, motor design, which in principle allows a decoupling of the contradictory lay-out requirements.

Positively controlled valves of this type cause a relatively complex control logic as a consequence of the required variable control times for the compression control and are restrained with inaccessibilities of the mechanical and/or hydraulic constructions used, as well as with high costs for mechanical components (such as camshafts, valve lifters, control rods, etc.), which previously prevented a further broadening of constructions of this type.

So, for example, an electromagnetically activated control of the suction valve of piston compressors has been known for some time, in which the one lifting handle engaging on the sealing element of the suction valve is moved via an electromagnet attached on the valve cover, the periodic excitation of which takes place by a collector which rotates synchronously with the crankshaft of the compressor. As a result of the partially very large backflow forces, which effect the sealing element of the suction valve, large electromagnets with corresponding current consumption are necessary, which is most disadvantageous and undesirable.

Furthermore, a pneumatic control unit for holding suction valves open during a part of the pressure stroke is known in which the influence of the valve to be kept open takes place via the gas itself which is to be compressed. The control occurs by means of a rotary valve, over which several individual cylinders, in which gripping pistons act, are periodically triggered. However, the complexity of the device is obviously limiting.

In connection with the supply quality control of piston compressors running at constant speed, the so-called reverse flow regulation proves itself at least partially by holding at least one suction valve open per cylinder over a certain range of the compression stroke, whereby the pressure forces or the flow forces of the gas pushed back through the suction valve that is held open can close the closing element of the suction valve after overcoming a certain part of the piston stroke, since from the other side, this closing element is acted upon by an opposing force corresponding to the desired reduction of the quantity supplied. The larger this opposing force, the later the suction valve closes in the compression stroke, so that the amount supplied is reduced. Since the suction valve suddenly does not further close when the opposing force is set too high, the control range for this type of compression control is limited in the upper range to avoid an intermittent idling of the compressor with its attendant problems.

In connection with the latter, embodiments are known in which the loading arrangement for the suction valve to be held open is preloaded hydraulically and pneumatically, whereby the supply quantity of the compressor can be influenced by variations of the appropriate preloading pressure.

Finally, arrangements of the type noted above are known from U.S. Pat. Nos. 3,104,801, 1,788,435 or 2,657,850 in which the pressure medium is fed periodically to the control cylinder which effects the closing element over the centrally arranged rotary valves or systems which are similar in construction to the known diesel injection pumps, which is shut off appropriately at the end of the desired backflow through the intake valve.

Embodiments are also known in which the supply of the pressure medium is blocked by means of a backflow valve for alleviating the pressure, so that the relief is throttled or reduced by a discharge having a separate, larger flow resistance.

The condition that the required high pressure for the periodic influence of the stroke movement of the closing element causes problems in regard to the mostly relatively larger rotational speeds and thus short periods of the stroke movement of the closing element is particularly disadvantageous in the known arrangements described above.

It is easily understandable that perhaps a high compressor speed only allows a very short time span for the periodic stroke movement of the closing element of a valve to be acted upon as described, which has larger lift rates associated with it for desired large opening cross-sections and a large lift of the closing element associated therewith and, for example, the danger of damaging and breaking the closing element at the end of the stroke movement. The high periodic pressure waves in the pressure medium effecting the closing element via the control cylinder can have additional problems in appearances of pressure waves in the conduits, which stand in the way in general of applying the technology known to date.

SUMMARY OF THE INVENTION

It is an object of the present invention to provide an improved arrangement and method of the type noted above so that the noted disadvantages of the known arrangements and methods are avoided, and so that an influence of the periodic stroke movement of the closing organ element can take place with particularly simple means so that even for larger required pressures of the pressure medium acting on the control cylinder and highly dynamic control processes, a reliable arrangement is achieved which does not tend toward the indicated disruptions over a long operational duration.

This problem is solved by the invention with an arrangement of the type noted above in that the control system includes at least one control element connected for supplying or releasing the pressure medium and gradually, variably accelerating or delaying this pressure formation and/or alleviation and thus also the stroke movement of the closing element. The corresponding configuration of the method of the invention is such that the pressure impact and/or alleviation of the closing element takes place variably through its stroke, at least gradually. The control element can control, for example, in the simplest case, a certain part of the suction valve of a compressor long maintaining the compression stroke, that at the beginning of the closing movement of the valve plate of the suction valve which releases the flow forces, this relief of the pressure occurs largely unthrottled and thus the corresponding valve plate movement takes place very quickly, against which reverse throttling of the pressure relieving can take place in passing before the valve plate strikes on the valve seat, such that a slowed and soft—at least on the border—striking of the valve plate on the valve seat takes place. Similar movement influences of the closing element of the valve can also be sensible in the opening direction of the valve plate as well, for example, when the unchecked striking of the open valve plate on a catching (guard) means is to be prevented.

In general, a largely free influence on the pressure formation and release in the pressure medium acting on the control cylinder can be conducted with the aforedescribed features and measures in accordance with the invention, which offers a broad range of influencing possibilities of the movement characteristic of the closing element of the associated valve.

The control element in a preferred further embodiment of the arrangement in the invention has at least one variable controllable actuating element, for example, a piezo valve with several actuating positions, which simultaneously form the control element as well. In accordance with another feature of the invention, the control element can also have at least one separate actuating element, preferably a magnetic or piezo valve with several actuating positions and an independent control element. Firstly, the controllable actuating element itself also forms the control element for the variable acceleration or delay of the pressure formation and release, i.e., over the flow-through cross-section that can be directly influenced to the control cylinder effecting the closing element, which makes a relatively simple and thus economical and reliable construction possible in accordance with the invention. Secondly, the design or arrangement of the separate actuating element is rather uncritical since only different paths for the pressure medium are triggered. First, the desired effects on the pressure formation and release are carried out through the control element which is constructively independent from the actuating element than according to the supply of the pressure medium carried out over the actuating element. This variation is more economical and easier to realize with current technology with regard to the construction of the arrangement and the course of the method.

In a particularly preferred embodiment of the device according to the invention, the control element has at least one displacement piston which can be moved by the pressure medium and which activates an actuating element to switch the flow of pressure medium between at least two different throttled paths. This is a very simple mechanical configuration of the control element, with which, for example, the checking noted above the valve plate of a suction valve held open for the moment can best be accomplished before impacting the valve seat.

Between the control element and a connected source of pressure medium, a backflow valve is provided in another preferred embodiment of the device of the invention, which offers the advantage that perhaps the pressure of the initial pump need not correspond to the largest force acting against the closing element, with which the power of the installed pump and the energy consumption can be lowered.

In regard to the reverse flow regulation of a piston compressor noted above by holding at least one suction valve open over at least a partial range of the compression stroke by means of the pressure action of the closing element of the suction valve, a further configuration of the method in accordance with the invention is advantageous in which the momentary alleviation of the pressure can take place at the end of the periodic partial range held open in each case largely unthrottled and then more greatly throttled. This type of compression regulation is advantageous in that the closing element, momentarily open, does not strike against the valve seat unchecked and with too great a rate under the effect of the backflow forces which are great at the point in time of their release and which could damage the valve seat and the valve plate or even the spring connections.

The pressure effect, which is at least gradually variable, of the closing element or the control cylinder effecting this, can also occur in both stroke directions in a further configuration of the method of the invention. Thus, a practically positive control of the closing element of the valve in each case results, which is considerably more flexible and better suited for piston compressors, for instance, than the mechanical control. The advantage of the method in the invention of course also remains for influencing the closing element in both stroke directions, that pressure formation and/or alleviation and thus the periodic stroke movement of the closing element can be influenced in a directed fashion.

DETAILED DESCRIPTION OF THE INVENTION

Figure 1:
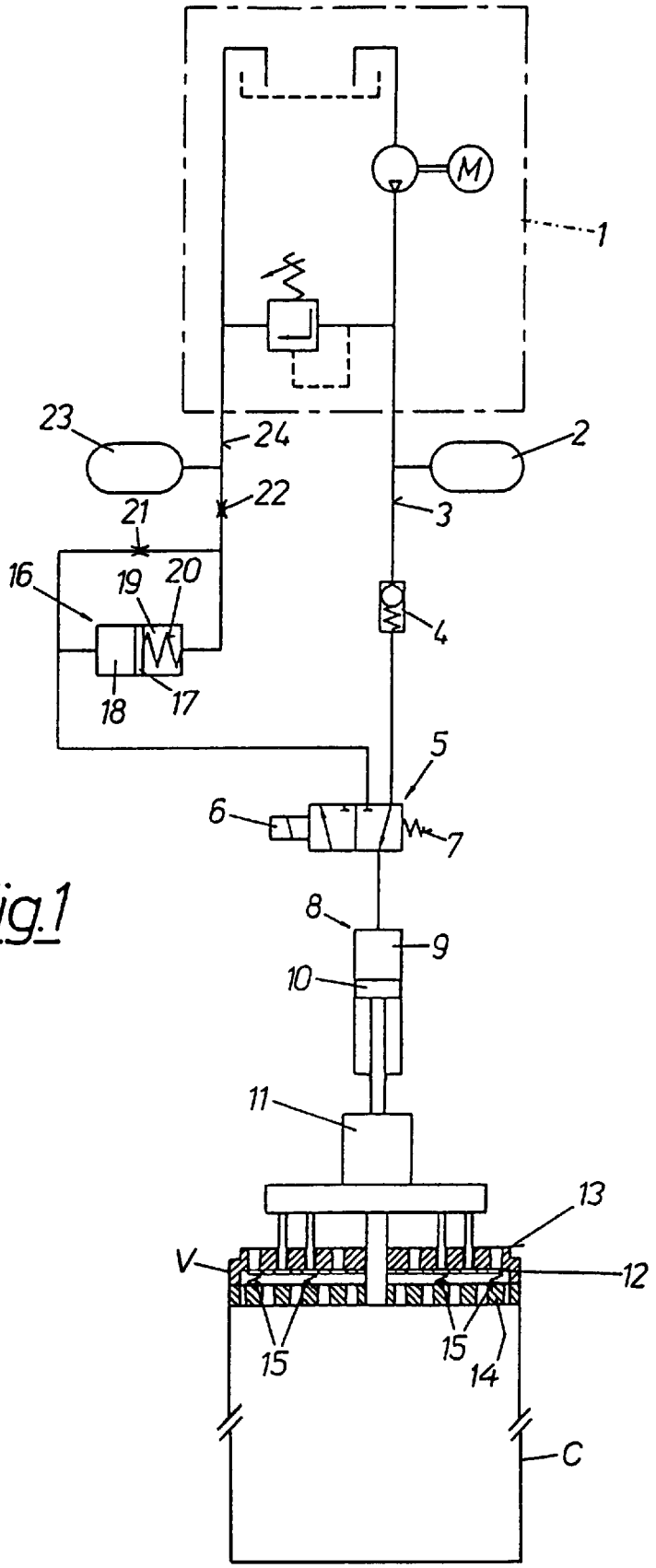
FIG. 1 is a schematic representation of a control system according to one embodiment of the present invention connected to a positively controlled suction valve of a piston compressor, the closing element of the suction valve being depicted in contact with the valve seat at the beginning of a stroke cycle.
Figure 2:
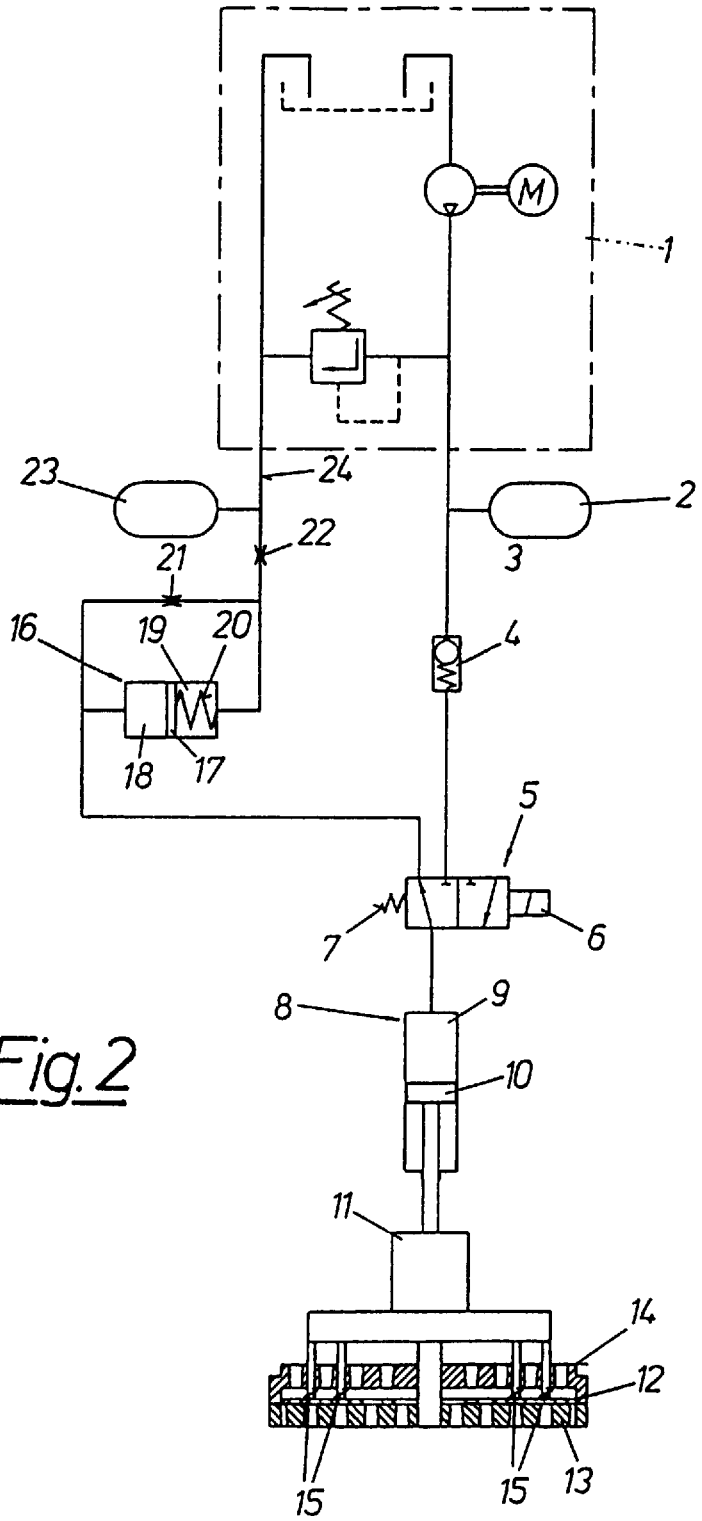
FIG. 2 is a schematic representation of a control system according to a second embodiment connected to a discharge valve of a piston compressor at the beginning of a stroke cycle.

In the embodiments shown in FIGS. 1 to 4, the movement of closing element 12 of a valve, V for example of a reciprocating piston compressor C, is transmitted by means of a suitable force transmission device 11 (for example, a so-called lifting handle as in FIGS. 1 and 2) to a piston 10 of a control cylinder 8. This control cylinder 8 is designed as a simple or double acting cylinder with work chamber 9 in FIGS. 1 and 2, or work chambers 9*a* and 9*b* in FIGS. 3 and 4, according to whether forces are to be transmitted in one direction or in both possible directions of movement. In the following, the embodiment which is simplest in operation will be described initially, i.e., in which only the upper work chamber 9 is acted upon by pressure medium (FIGS. 1 and 2). Such an arrangement is suitable, for example, for influencing the closing of the suction valve or the opening of the discharge valve of reciprocating piston compressors of the type in accordance with the invention.

A hydraulic system 1, for example equipped with a pump, motor, tank and adjustable pressure limit valve, supplies a 3/2 port directional control valve 5, for instance, which is operated magnetically, with pressure medium via conduit 3. As long as the magnet 6 remains unenergized, a spring 7 pushes the valve 5 to the indicated switch position. Thus, pressure medium flows into the work chamber 9 of control cylinder 8 and influences the piston 10, which pushes the force transmission device 11 against sealing (closing) element 12 of the compressor valve and causes it to open (move away from valve seat 13).

In the suction valve depicted in FIG. 1, the valve is opened or fixed in the open position if closing element 12 is moved against guard means 14. At the end of the suction cycle of the compressor cylinder associated with the valve, that is to say, when the bottom dead center is reached, the flow forces exerted on closing element 12 by the medium of the compressor reverse in direction and attempt to close closing element 12. These forces are amplified by the effect of a generally common closing spring 15 of the valve. The pressure in the working chamber 9 of the control cylinder 8 increases until it exceeds the pressure delivered by hydraulic system 1, whereupon backflow valve 4 connected in conduit 3 upstream of the 3/2 port directional control valve 5 blocks the backflow of the pressure medium, so that the position of the piston remains fixed.

By supplying magnet 6 of valve 5 with current, control valve 5 will reverse and allow a backflow of the pressure medium from control cylinders toward an auxiliary cylinder 16, which contains a piston 17 that defines work chambers 18, 19. The volume of the work chamber 18 is selected in the example shown so that the stroke movement of piston 17 accommodates that portion of the pressure medium which is displaced during the first part of the movement of the piston 10. The pressure medium displaced by piston 17 from work chamber 19 flows out through throttle valve 22, which symbolizes the flow resistance of the total arrangement and is laid out to have as little loss as possible.

As soon as piston 17 has achieved its end position, only the discharge over throttle valve 21 is then available to throttle the pressure medium displaced by piston 10 of the control cylinder, the throttle valve 21 having a significantly higher resistance to throughflow than throttle valve 22, so that from this point in time of movement of piston 10, a force opposing movement of piston 10 increases several fold, and thus a significant retardation of the movement of closing element 12 is initiated. The closing element 12 impacts the valve seat 13 as a result with greatly reduced velocity.

According to each embodiment, force transmission device 11 is connected with closing element 12 either rigidly or, as in FIGS. 1 and 2, only in contact from time to time. In this latter condition, the force transmission device 11 is lifted from the closing element as soon as device 11 reaches its end position at seat 13. The remaining movement of the force transmission device 11 is damped as a result of the strong throttling of the discharge of the pressure medium, so that the force transmission device 11 then comes to a significantly decelerated stop. It can then be safeguarded that piston 10 reaches the stroke limit at very slow speed, such that any damage to piston 10 or to the associated control cylinder 8 is avoided. For safety reasons, a stroke limit of this type is designed constructively so that a hydraulic cushioning of the end position is assured. In practical operation of the arrangement, piston 10 does not reach this end position, so that the known disadvantage of hydraulic cushioning of the end position, namely the more difficult breaking out of the end position with the introduction of the counter movement can be avoided.

As soon as the discharge of the pressure medium from work chamber 9 is complete, piston 17 begins to move back to its starting position under the effect of spring 20. Thus, spring 20 must overcome the pressure forces as a result of the overflow from work chamber 19 into work chamber 18 through throttle valve 21 as well as the inertia of piston 17 itself. Thus, one operational cycle of the arrangement is then complete.

The rest position of the 3/2 port directional control valve 5 is to be selected according to the safety requirements. Advantageously, the 3/2 port directional control valve 5 causes connection between and the hydraulic system 1 and the control cylinder 8 when in the unactivated state, so that the piston 10 is fixed in the lower position and the compressor works in idle.

For the sake of completeness, reference is made to pressure medium storage 2 or 23 as a pulsation damper in the flow and backflow of the pressure medium, which serve in preventing fluids from striking and avoiding the undesired reactionary effects on the movement of piston 10 associated with it and also on force transmission device 11 and closing element 12.

In the condition shown in FIG. 2 for controlling discharge valves of a piston compressor, the movement of closing element 12 through catching means 14 is carried over to piston 10 by means of force transmission device 11. The 3/2 port directional control valve 5 releases the connection of work chamber 9 of the control cylinder to work chamber 18 of auxiliary cylinder 16 when in the rest position. As soon as the gas forces acting on the closing element overcome the force of closing spring 15 of the valve, the pressure medium begins to flow out. As in the function explained for the suction valve as in FIG. 1, the movement of closing element 12 is initially slowed only slightly. Just before impacting catching means 14, the weakly throttled discharge of the pressure medium is interrupted. The pressure medium must now overcome throttle valve 21, through which a strong retardation of the movement of closing element 12 is achieved. Analogous to the description for the suction valve, force transmission element 11 can also extend out severely checked. To initiate the movement of closing element 12, the 3/2 port directional control valve 5 is reversed by supplying current to magnet 6 at a suitable time before reaching the upper dead center point of the compression piston. Thus the pressure medium can flow in and the closing element can push against valve seat 13. The significance is that the feed motion of force transmission device 11 already takes place when reaching the upper dead center point of the compression piston for the most part but is not yet completed. Thus a recompression of the working medium of the compressor and the additional losses caused thereby can be avoided. On the other hand, the possibility of a late closing of closing element 12 and the danger of higher impact velocities connected with it are limited. With the reverse of the flow direction of the compressed gas, only a small remaining stroke is still available to the closing element 12, so that the closing velocity resulting from a possible late closing is meaningless in regard to a possible increase in wear and tear.

With regard to other features and functional details of the arrangement depicted in FIG. 2, reference is made to the description above for FIG. 1 to avoid repetition.

Figure 3:
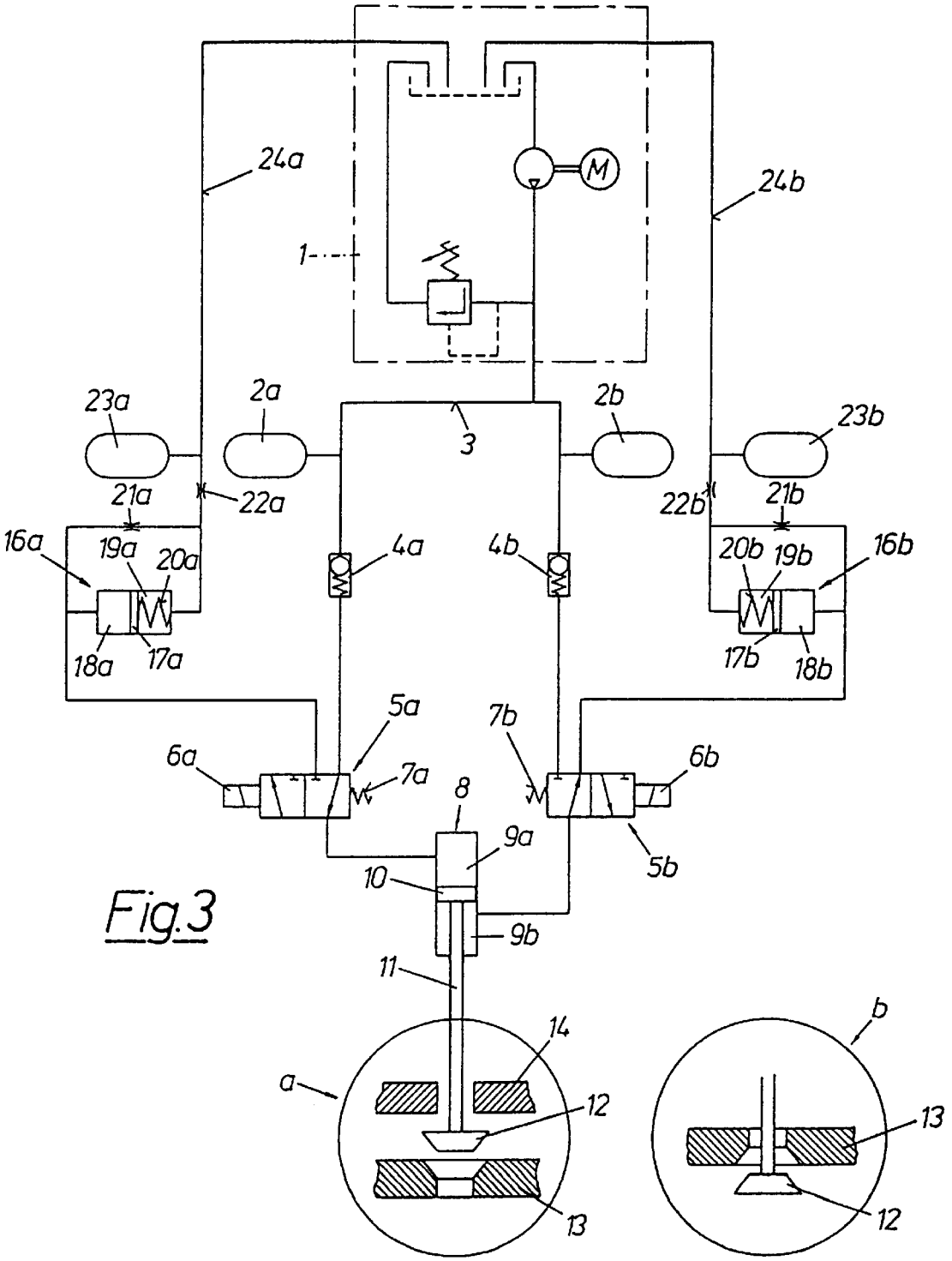
FIGS. 3 and 4 are schematic representations of a control system according to third and fourth embodiments of the invention connected to automatic valves for piston compressors, the closing elements being shown in the middle of a stroke cycle.
Figure 4:
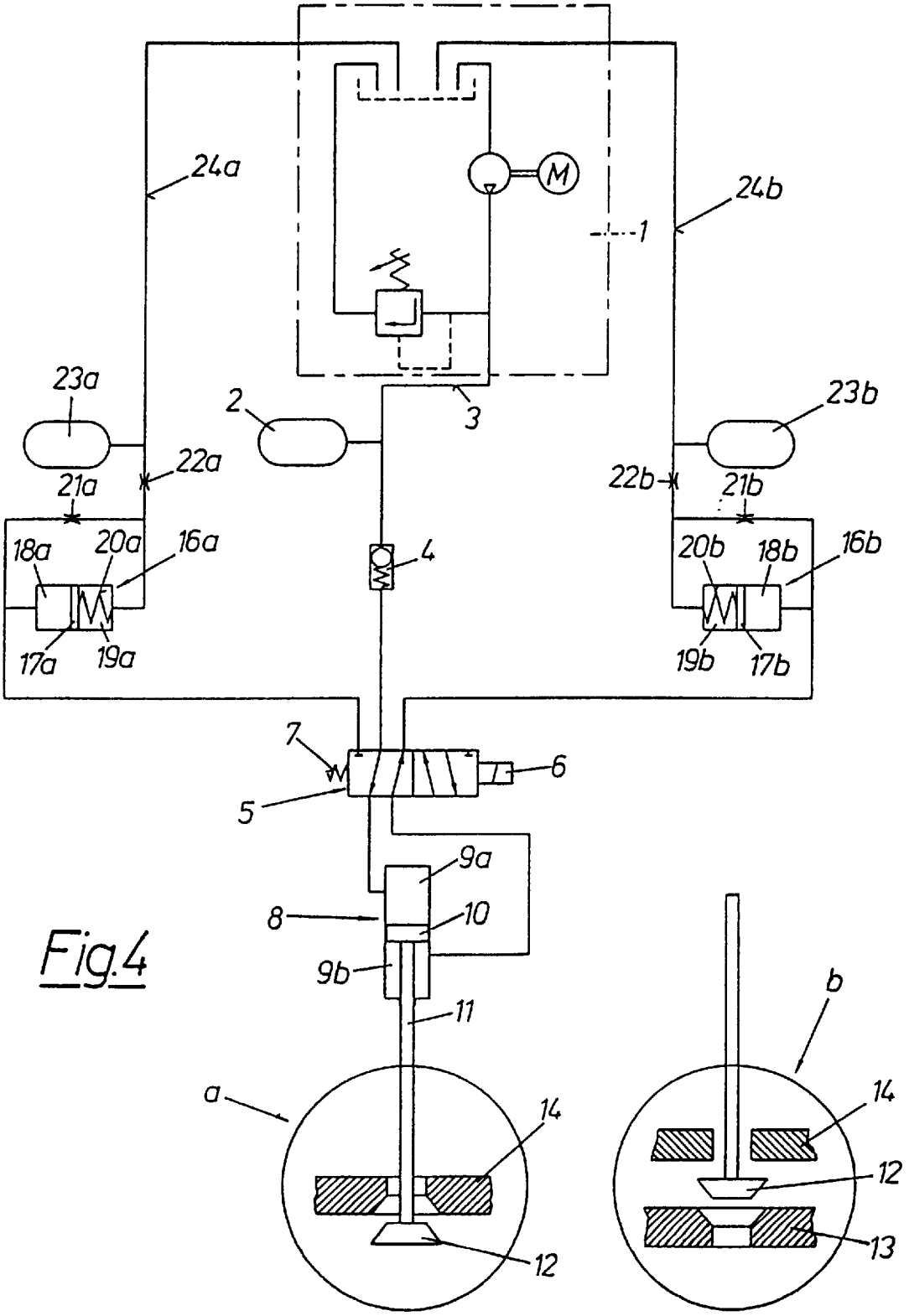

FIGS. 3 and 4 show embodiments with double acting control cylinders, whereby piston 10 cooperates with active work chambers 9*a* and 9*b*. Here, the closing element 12, force transmission device 11 and piston 10 are connected rigidly together and subjected to a variable damping in both movement directions of piston 10 in control cylinder 8. Position movement in each case is introduced through synchronous switching of the 3/2 port directional control valve 5*a*, 5*b* or by switching the 5/2 port directional control valve 5 in FIG. 4. The positioning force of the work chamber of the control cylinder impacted with pressure medium is added to the gas forces engaging on the sealing element 12 in each case. Thus the movement of closing element 12 can be set largely independently from the timed course of the gas forces, with which a complete control of compressor valves can be realized, for example.

With regard to the other features and functional details of the embodiments shown in FIGS. 3 and 4, reference is made to the corresponding explanations for FIGS. 1 and 2 to avoid repetition. For enlarged drawing portions a or b, the various embodiments or arrangements of sealing element 12 for the suction valve or the pressure valve are indicated.

Figure 5A:
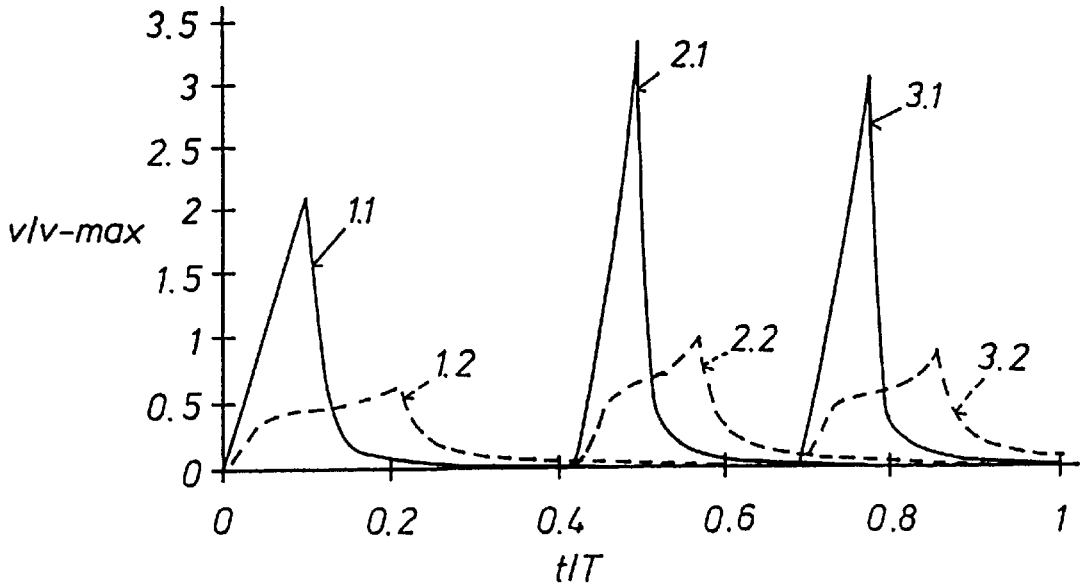
FIGS. 5*a* and 5*b* are graphs showing courses of the velocity v or the pressure p for different points of work of a suction valve control in accordance with the invention compared to the prior art.

FIG. 5*a* is a graph representing courses of the velocity v of force transmission device 11 or of closing element 12 during a compression cycle of duration T for different working points of a suction valve control. Curves 1.1 and 1.2 represent full load, curves 2.1, 2.2 and 3.1 or 3.2 represent partial load. The curves relate to the maximum impact velocity v-max of sealing element 12 on the valve seat (determined over all types of load).

Figure 5B:
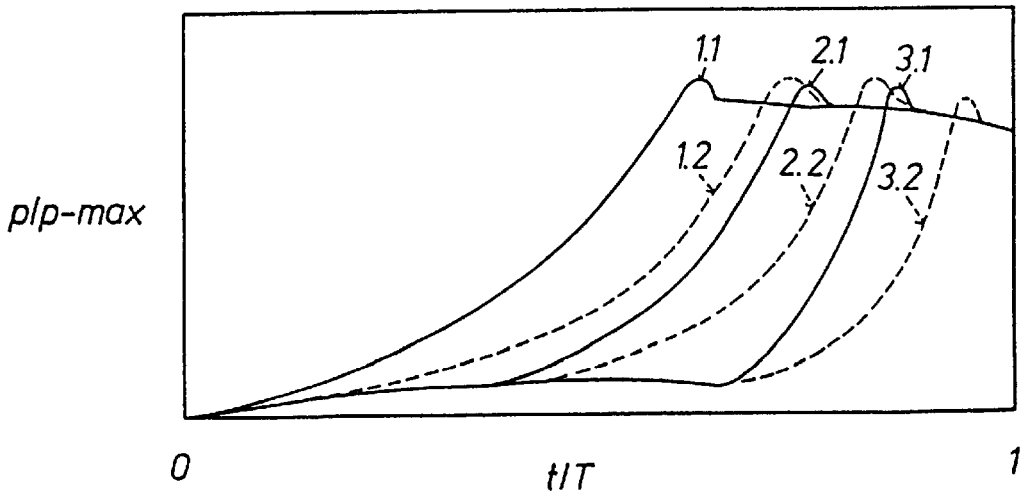

In FIG. 5*b*, the corresponding courses of the pressure p in the work chamber of the compressor are depicted versus the time t. The curves designated 1.1, 2.1 and 3.1 represent the behavior of a compressor level, the suction valve of which is equipped with variable movement damping. The dotted line curves, designated 1.2, 2.2 and 3.2 represent suction valves with constant movement damping (according to the prior art) whereby the damping is laid out so that the maximum impact velocity of closing element 12 on the valve seat is about the same magnitude for variable and constant damping.

The curves 1.1 and 1.2 illustrate that the closing movement of closing element 12 is initiated in the bottom dead center point of the compressor cylinder in each case by reversing the control element. With increasing piston velocity and beginning compression, the working medium of the compressor exercises an increasing closing force on closing element 12, which is superimposed on the force of the closing spring 15 (see FIGS. 1 and 2). For variable damping, the pressure medium can flow out nearly undamped at first, so that the closing force is largely available for the acceleration of the closing element and the force transmission device. For constant damping, a throttle must be selected to be much smaller than otherwise so that at the beginning a good portion of the closing force is required to overcome the throttle resistance. Accordingly, the sealing element approaches the valve seat more quickly for variable damping in accordance with the present invention than for constant damping according to the prior art. At a distance of about 20% of the stroke distance from the seat, the throttling of the pressure medium discharge is increased several times for the variable damping so that the movement suddenly encounters more resistance and is correspondingly slowed. The closing element moves then toward the seat with a significantly reduced velocity, the force transmission device lifts from the closing element and leaves quickly at a velocity as described.

Assuming the same impact velocity of the closing element in both cases, the closing process for constant damping takes significantly longer than with variable damping. During the duration of the closing process, the gas to be compressed flows back, through which an undesired loss of a supply quantity and additional working losses are yielded, which can be seen from FIG. 5*b*, for example, by comparing the curves 1.1 and 1.2.

If the activation of the control element takes place at a later time (curves 2.1, 2.2, 3.1 and 3.2), then the supplied amount and, accordingly, the driving capacity of the compressor, are reduced. In all the depicted and discussed exemplary embodiments, only the variable throttling of the pressure release of the work chambers of the control cylinder is realized or addressed. Except for that, it would of course be possible as well to design the pressure formation variable in the work chamber in the control cylinder in each case to have, for example, a larger adjustment velocity available at the beginning of the corresponding operational stroke of this control cylinder than at the end. It can also be advantageous deviating from the described embodiments for different applications, for example, to have smaller adjustment velocities at the beginning of the stroke in each case of the control cylinder and larger velocities available toward the end. Also, mixed forms with graduated or variable velocity increases and reductions over the entire stroke of the control cylinder are possible and simple to realize in accordance with the present invention. Furthermore, solutions with correspondingly quick switching control elements or actuating elements, for example, in combination with suitable pressure sensors, can be realized for which pressure waves in the pressure medium are either eliminated or appropriately influenced or even amplified, so that the most varied influences on the movement characteristic of the controlled closing element are possible.

What is claimed is:

1. A combination of an automatic valve for a piston compressor and a control system for controlling operation of said valve, said automatic valve comprising: a valve seat having an opening for flow of a first fluid therethrough, a guard having an opening for flow of said first fluid therethrough, and a closing element movable in strokes between said valve seat and said guard to control flow of said first fluid through said valve, and said control system comprising:

a first control cylinder and a first piston which is movable in said control cylinder to define first and second working chambers in said first control cylinder on opposite sides of said piston, a connection means having first and second ends, said first end extending through said second working chamber of said first control cylinder and connected to said first piston and said second end extending into said automatic valve to contact said closing element and control movement of said closing element between said valve seat and said guard, supply means providing a flow of second fluid under pressure, a damper system, and a first control valve connected to said first control cylinder, to said supply means and to said damper system to enable second fluid from said supply means to flow into said first working chamber of said first control cylinder or to enable second fluid in said first working chamber of said first control cylinder to flow to said damper system, said damper system comprising a first throttle valve, a second throttle valve which has a greater resistance to second fluid flow therethrough than said first throttle valve, a second control cylinder having a second piston movable therein to define first and second working chambers on opposite sides of said second piston, and fluid connections which enable second fluid to flow from said first working chamber of said first control cylinder through said first fluid control valve to said first working chamber of said second control cylinder and move said second piston therein such that fluid in said second working chamber thereof flows through said first throttle valve, and after said second piston has stopped moving within said second control cylinder, to flow through said second throttle valve, the increased resistance to second fluid flow of said second throttle valve relative to said first throttle valve resulting in a decreased speed of movement of said first piston in said first control cylinder and thus, via said connection means, a decreased speed of movement of said closing element within said automatic valve.

2. A combination as defined in claim 1, wherein said supply means for providing a second fluid under pressure comprises a one way valve to prevent a backflow of second fluid from said first control valve to said supply means.

3. A combination as defined in claim 1, wherein said second control cylinder includes a spring means in said second working chamber thereof to oppose movement of said second piston includes a spring means in said second working chamber thereof to oppose movement of said second piston in response to second fluid flowing into said first working chamber thereof.

4. A combination as defined in claim 1, wherein said first control valve is a 3/2 port directional control valve.

* * * * *